United States Patent [19]

Carson

[11] 4,049,157

[45] Sept. 20, 1977

[54] POUR SPOUT CONSTRUCTION

[76] Inventor: Eunice Carson, 9910 S. Clyde Ave., Chicago, Ill. 60617

[21] Appl. No.: 645,706

[22] Filed: Dec. 31, 1975

[51] Int. Cl.[2] ..... B07B 7/26

[52] U.S. Cl. ..... 222/81; 222/189; 222/505; 222/517

[58] Field of Search ..... 222/81, 82, 228, 247, 222/517, 564, 501, 505, 510, 189

[56] References Cited

U.S. PATENT DOCUMENTS

| | | | |
|---|---|---|---|
| 584,900 | 6/1897 | Scott | 222/510 X |
| 2,051,138 | 8/1936 | Gebhardt | 222/517 X |
| 2,552,154 | 5/1951 | Danielson | 222/81 |
| 2,805,793 | 9/1957 | Crisafulli | 222/81 |
| 2,877,867 | 3/1959 | Cain et al. | 222/510 X |
| 2,899,100 | 8/1959 | Wolkenberg | 222/81 X |
| 3,062,409 | 11/1962 | Schneider | 222/81 |
| 3,425,603 | 2/1969 | Medlin | 222/517 |

*Primary Examiner*—Drayton E. Hoffman
*Assistant Examiner*—Fred A. Silverberg
*Attorney, Agent, or Firm*—Clarence A. O'Brien; Harvey B. Jacobson

[57] ABSTRACT

An upright hollow cylindrical body is provided including a hollow laterally outwardly projecting prong on one side. The prong tapers outwardly from the body and is pointed at its outer end. Further, the prong is generally in the shape of a three-sided pyramid somewhat elongated in a direction extending longitudinally of the hollow body. Two sides of the prong extend longitudinally of the body and a short side of the prong extends transversely of the body. The interior of the prong opens directly into the interior of the body and the two long sides of the prong are provided with openings therethrough whereby, when the prong is pushed through the side wall of a container for granular material, granular material may flow through the openings, into the interior of the prong and then directly into the interior of the hollow body. The lower end of the hollow body includes a manually actuatable dispensing door whereby granular material within the body may be dispensed therefrom.

10 Claims, 4 Drawing Figures

POUR SPOUT CONSTRUCTION

BACKGROUND OF THE INVENTION

Various forms of pouring spouts for piercing a wall portion of a container and then dispensing fluent material from the container have been heretofore designed. However, most of these pour spouts have not been specifically designed for use in piercing the side walls of containers for granular materials and ease and reliability of operation.

Examples of pour spouts including some of the general structural features of the instant invention are disclosed in U.S. Pat. Nos. 2,024,913, 2,333,781, 2,442,126, 2,609,967 and 2,805,793.

BRIEF DESCRIPTION OF THE INVENTION

The pour spout has been specifically designed for piercing the side walls of containers for granular materials and more specifically for piercing the side walls of cardboard containers and the like although the spout may also be utilized to pierce thin metal container side walls.

The main object of this invention is to provide a pour spout operable to pierce the side wall of a container for granular material and which will thereafter be operative to dispense granular material from the container.

Another object of this invention, in accordance with the immediately preceding object, is to provide a pour spout specifically adapted to enable a cardboard box of a material such as granular detergents or washing powders to have the granular materials therein quickly and easily dispensed therefrom.

Yet another object of this invention is to provide a pour spout which will be operative to dispense predetermined amounts of granular materials from an associated container of granular materials.

Still another important object of this invention is to provide a pour spout in accordance with the preceding objects and including a readily operable actuator whereby the predetermined amount of granular material may be dispensed when desired.

A further object of this invention is to provide a pour spout of a construction enabling its easy use by persons having only limited knowledge of its general operation.

A final object of this invention to be specifically enumerated herein is to provide a pour spout in accordance with the preceding objects and which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
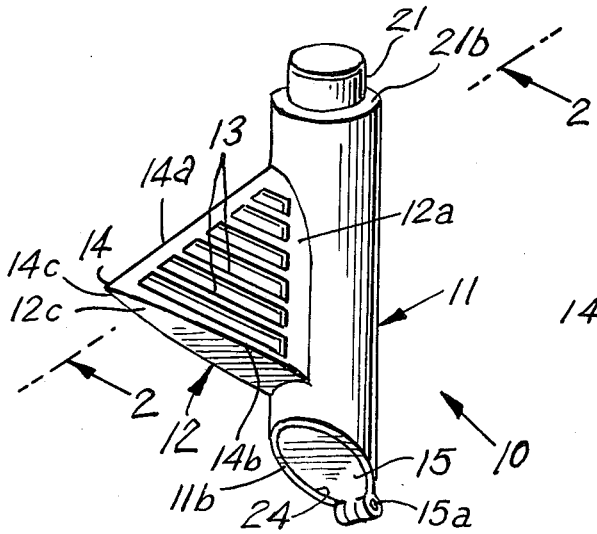
FIG. 1 is a perspective view of the pour spout.

Referring now more specifically to the drawings, the numeral 10 generally designates a first form of pour spout constructed in accordance with the present invention. The spout 10 includes a hollow cylindrical body referred to in general by the reference numeral 11 and including a three-sided horizontally disposed and generally pyramidal shaped hollow prong referred to in general by the reference numeral 12 supported from and projecting outwardly of one side of the body 11. The base of the hollow prong opens directly into the interior of the body 11 intermediate the opposite ends thereof through an elongated opening **11*a* formed in and extending along the side of the body 11 from which the prong 12 is supported. The prong 12 is defined by a pair of long opposite side walls 12*a* and 12*b* extending along opposite sides of the opening 11*a* and converging toward the upper end of the body 11. The side walls 12*a* and 12*b* are interconnected along their lower marginal edge portions by means of a lower side wall 12*c*** extending and secured therebetween.

The walls **12*a*, 12*b* and 12*c* converge to form a pointed apex as at 14 and the intersection of the adjacent edges of the side walls 12*a* and 12*b* form a first sharpened edge 14*a* while the intersections between the side walls 12*a* and 12*b* and the side wall 12*c* form sharpened edges 14*b* and 14*c*. The side walls 12*a* and 12*b* each include elongated slot-type openings 13 formed therethrough spaced from the edges 14*a*, 14*b* and 14*c* as well as the body 11. It will be noted from FIG. 1 of the drawings that the slot-type openings in each side wall 12*a* and 12*b* parallel each other and the side wall 12*c*.**

The lower end of the body 11 is beveled as at **11*b* and has a hinged cover or door 15 pivotally supported therefrom as at 15*a*. The inner side of the door or cover 15 includes an attaching lug 16 to which the lower end of an upstanding operating rod 17 is pivotally attached. The upper end portion of the rod 17 projects upwardly through a central aperture or bore 18 formed in a horizontal internal wall or partition 19 formed integrally with the body 11 and extending thereacross at the upper extremity of the prong 12.**

Figure 2:
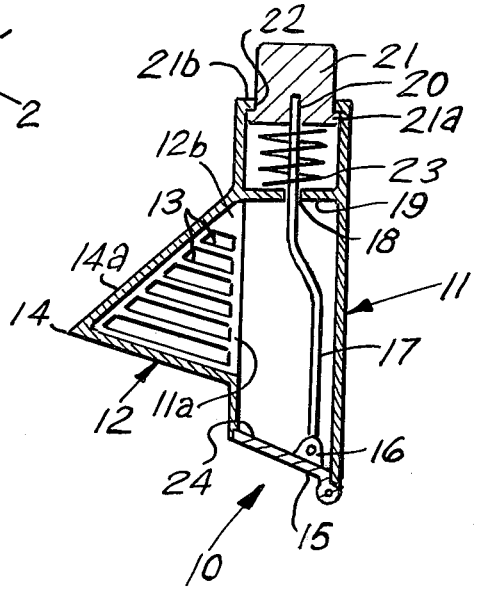
FIG. 2 is a vertical sectional view taken substantially upon the plane indicated by the section line 2—2 of FIG. 1.

The upper terminal end of the rod 17 is anchored within a central downwardly opening blind bore 20 formed in the lower end of a push button 21 snugly and slidably received within the upper end of the body 11 above the partition 19. The push button 21 includes a lower end outwardly projecting annular shoulder **21*a* slidably received within the upper end of the body 11 and the upper terminal end of the body 11 includes an inwardly projecting annular flange 21*b* against which the shoulder 21*a* is engageable to limit upward displacement of the push button 21 within the body 11. The inner peripheral edge of the flange 21*b* defines an opening 22 through which the upper end of the push button 21 above the shoulder 21*a* is slidably received. Thus, the push button 21 is slidably and guidingly engaged at two points spaced vertically therealong from the body 11. Furthermore, a compression spring 23 is disposed about the rod 17 between the lower end of the push button 21 and the upper surface of the wall or partition 19** and thereby yieldingly biases the push button 21 and the rod 17 toward the uppermost limit positions of movement thereof illustrated in FIG. 2 with the cover or door swung to the closed position closing the opening 24 defined by the beveled lower end of the body 11.

Figure 3:
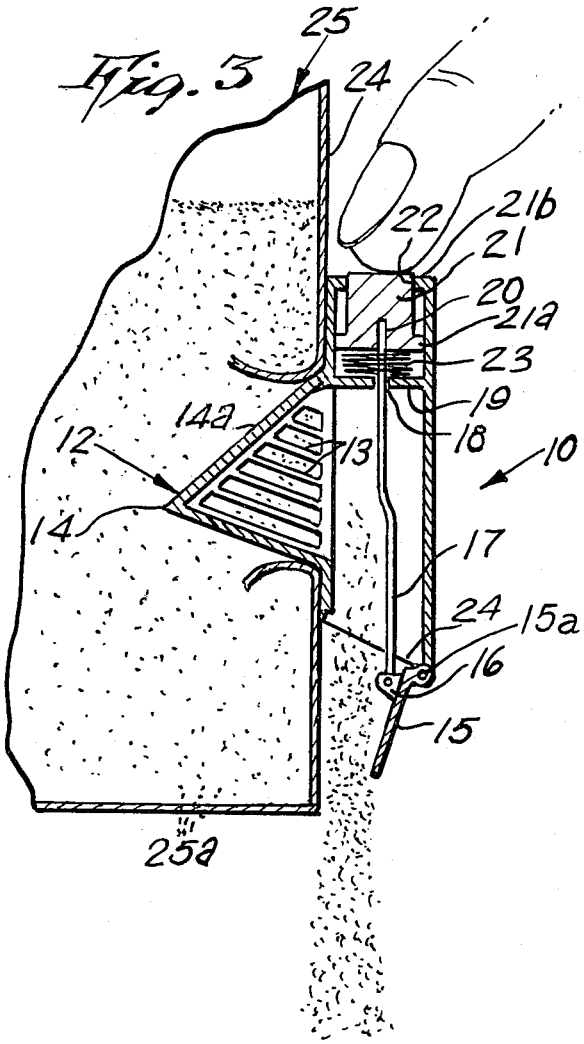
FIG. 3 is a fragmentary vertical sectional view taken substantially upon a plane passing through one wall portion of a container for granular material and with the pour spout having its prong portion extending through the wall of the container and the closure door of the spout in the open positionthereof so as to dispense granular materials from the container.

In operation, the pour spout 10 is advanced toward the side wall 24 of a box 25 or other container of granular material 25*a* with the apex or point 14 of the prong 12 facing the side wall 24. After contact of the point 14 is made with the side wall 24 the pour spout 10 is forced further toward the outer side of the side wall 24 so as to cause the prong 12 to penetrate and be projected through the side wall 24 to the position thereof illustrated in FIG. 3 with the side of the body 11 from which the prong 12 is supported abutted against the outer side of the side wall 14. The granular material 25*a* within the box 25 may thereafter flow through the slot-like openings 13 and into the interior of the body 11. After the granular material has flowed into and filled the interior of the body 11 below the partition 19, downward finger pressure may be applied to the upper end of the push button 21 projecting upwardly from the upper end of the body 11 so as to downwardly depress the push button 21 to the position thereof illustrated in FIG. 3 thereby causing the cover or door 15 to swing to the open position thereof illustrated in FIG. 3 in order to dispense the granular material contained within the body 11 and the interior of the prong 12 through the lower end opening 24 of the body 11. This dispensing operation is completed momentarily before any appreciable amount of additional granular material may flow through the slot-type openings 13 and into the interior of the prong 12. Of course, as soon as the granular material has been dispensed from the lower end opening 24 of the body 11 finger pressure on the push button 21 may be released in order that the spring 23 may again return the push button 21 and the rod 17 to their uppermost limit positions illustrated in FIG. 2 of the drawings with the cover or door again swung to the closed position thereof. The bevel at the lower end of the body 11 is not so great as to cause interference between the free swinging edge of the cover or door 15 and the lower portion of the side wall 24 as the cover or door 15 is swung between its open and closed positions.

Figure 4:
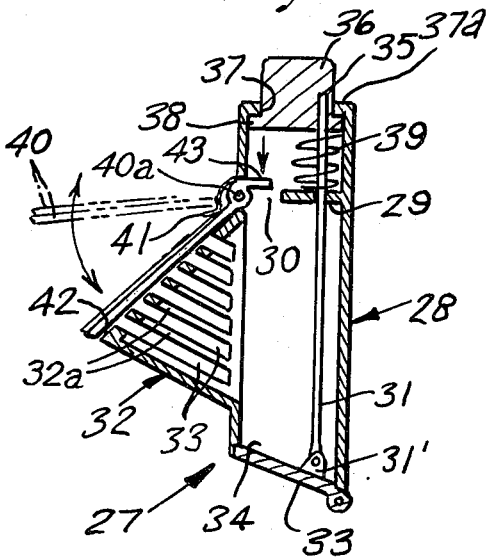
FIG. 4 is a vertical sectional view similar to FIG. 2 but illustrating a modified form of pour spout.

Referring now more specifically to FIG. 4 of the drawings, a modified form of pour spout referred to in general by the reference numeral 27 is disclosed. The spout 27 includes a body 28 corresponding to the body 11 and including a partial partition 29 corresponding to the partition 19. However, a portion of the partition 29 is omitted to define an opening 30 and the rod 31 and lug 31′ corresponding to the rod 17 and lug 16 are disposed to the side of the body 28 remote from the prong 32 corresponding to the prong 12. Further, the spout 27 includes a cover or door 33 corresponding to the cover or door 15 and which closes the opening 34 defined by the lower beveled end of the body 28.

Although the prong 32 corresponds to the prong 12, the openings 33 thereof corresponding to the openings 13 are defined by V-shaped teeth 32*a* whose apex portions extend along that portion of the prong 32 corresponding to the sharpened edge 14*a* of the prong 12. In addition, the upper end of the rod 31 received through the aperture in the partition partition 29 is secured within an eccentrically located blind bore 35 opening downwardly through the button 36 corresponding to the button 21. Further, the upper end of the body 28 includes an inturned annular flange 37*a* corresponding to the flange 21*b* and defining a bore 37 through which the upper portion of the button 36 is slidingly received and the lower end of the button 36 includes a radially outwardly projecting and circumferential shoulder 38 abuttingly engageable with the flange 37*a* to limit upward sliding of the button 36. Also, a compression spring 39 corresponding to the compression spring 23 is disposed about the rod 31 between the underside of the button 36 and the upper side of the partial wall or partition 29.

A pair of generally parallel spring tines 40 are connected together at one pair of corresponding ends and pivotally supported as at 40*a* within an opening formed in the body 27 above the prong 32. A spring 41 is supported from the body 28 and acts upon the base ends of the tines 40 to yeildingly bias the latter from the open phantom line positions thereof illustrated in FIG. 4 to the rest positions thereof illustrated in solid lines in FIG. 4 with the free ends of the tines abutting against the edge 42 of the prong 32. In addition, the pivoted ends of the tines 40 include a tab 43 which projects inwardly through the opening of the body 28 above the prong 32 and the tab 43 is engageable by the underside of the button 36 when the latter is depressed to open the cover or door 33. Accordingly, the tines 40 may be swung from the solid line positions thereof illustrated in FIG. 4 to the phantom line positions thereof illustrated in FIG. 4 as the cover or door 33 is opened in order to break up any clump of granular material within the associated container adjacent and above the prong 32.

Otherwise, the pour spout 27 operates in substantially the same manner as the pour spout 10. Of course, each of the spouts 10 and 27 may have substantially all of the components thereof except for the springs 23, 39 and 41 constructed of relatively inexpensive and durable plastic materials.

What is claimed as new is as follows:

1. A pouring spout including a multi-sided hollow body, a hollow outwardly tapering prong carried by and projecting outwardly from one side of said body, said one side of said body having an opening formed therein communicating the interiors of said prong and body for rapid flow of granular material from within the interior of said prong into the interior of said body, said body defining a discharge opening remote from said prong, closure means shiftably supported from said body and rapidly movable into and out of positions closing and opening the discharge opening, said prong including side walls extending outwardly from said body and converging toward a pointed outer end of said prong, spring means operably connected between said body and closure means yieldingly biasing the latter toward its closed position, and operator means shiftably supported from said body and operatively connected with said closure means for movement of said closure means between its open and closed positions upon shifting of said operator means relative to said body, said prong being in the form of a multisided pyramid, two adjacent sides of said prong being defined by the sets of corresponding legs of a plurality of side-by-side V-shaped teeth spaced along said prong and progressively increasing in size outwardly from said body.

2. The combination of claim 1 including elongated tine means extending along the upper apex portions of said inverted V-shaped teeth, the end of said tine means adjacent said body being pivotally supported therefrom for oscillation about a horizontal transverse axis and including a tab portion projecting into said body through an opening provided therefor, the portion of said tab projecting into said body being engageable by said operator means for oscillating said tine means in response to back-and-forth shifting of said operator means.

3. A pouring spout including an upstanding elongated hollow body, a hollow outwardly tapering prong carried by and projecting outwardly from one side of said body, said one side of said body having an opening formed therein communicating the interiors of said prong and body for rapid flow of granular material from within the interior of said prong into the interior of said body, the lower end of said body defining a downwardly opening discharge opening, closure means shiftably supported from said body and rapidly movable into and out of positions closing and opening the discharge opening, said prong including side walls extending outwardly from said body and converging toward a pointed outer end of said prong, at least one of said prong side walls having at least one opening formed therethrough, spring means operably connected between said body and closure means yieldingly biasing the latter toward its closed position, and operator means shiftably supported from said body for back and forth oscillating movement relative thereto between active and inactive positions and readily engageable from the exterior of said body, connecting means operatively connected between said closure means and said operator means for movement of said closure means between its open and closed positions upon shifting of said operator means between its active and inactive positions, respectively, said connecting means including an elongated longitudinally reciprocal rod extending lengthwise in said body, connected at its lower end to said closure means, and connected at its upper end to said operator means, wherein said prong is generally in the form of a three-sided pyramid, at least two sides thereof having at least one opening formed therethrough, wherein said two sides of said pyramidal prong are defined by the sets of corresponding legs of a plurality of inverted V-shaped teeth spaced along said prong and progressively increasing in size outwardly from said body, the third side of said prong closing the space between the legs of the outermost inverted V-shaped tooth.

4. The combination of claim 3 wherein said closure means comprises a door extending across the lower end of said body and hingedly supported at one marginal portion from a corresponding marginal portion of said body for swinging about a horizontal axis.

5. The combination of claim 4 wherein the upper end of said body defines an upwardly opening bore opening inwardly into the interior of said body, said operator means comprising a push button reciprocal in said bore and projecting outwardly of the upper end thereof, the upper end of said rod being anchored to said button.

6. The combination of claim 5 wherein said button and the upper end portion of said body include coacting button and body portions defining limits of shifting of said button relative to said body.

7. The combination of claim 6 wherein said spring means comprises a compression spring disposed about said rod between said button and one of said body portions.

8. The combination of claim 2 wherein said two sides each have a plurality of parallel slot-type openings formed therethrough.

9. The combination of claim 2 wherein the juncture between adjacent pairs of sides of said pyramid define sharpened outer edges.

10. The combination of claim 3 including elongated tine means extending along the upper apex portions of said inverted V-shaped teeth, the end of said tine means adjacent said body being pivotally supported therefrom for oscillation about a horizontal transverse axis and including a tab portion projecting into said body through an opening provided therefor, the portion of said tab projecting into said body being engageable by said operator means for oscillating said tine means in response to back-and-forth shifting of said operator means.

* * * * *